US011385574B2

(12) United States Patent
Baba et al.

(10) Patent No.: US 11,385,574 B2
(45) Date of Patent: Jul. 12, 2022

(54) ROTATION DEVICE AND IMAGE FORMING APPARATUS

(71) Applicant: FUJIFILM Business Innovation Corp., Tokyo (JP)

(72) Inventors: Toshiaki Baba, Kanagawa (JP); Yoko Miyamoto, Kanagawa (JP); Koichiro Yuasa, Kanagawa (JP); Tomoaki Yoshioka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/334,093

(22) Filed: May 28, 2021

(65) Prior Publication Data

US 2022/0107590 A1 Apr. 7, 2022

(30) Foreign Application Priority Data

Oct. 2, 2020 (JP) ..... JP2020-167886

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 5,260,754 A * 11/1993 Yano ..... G03G 21/0035 15/256.5
6,151,477 A * 11/2000 Takeuchi ..... G03G 15/0131 399/297

FOREIGN PATENT DOCUMENTS

JP 58-005769 A 1/1983

* cited by examiner

*Primary Examiner* — Clayton E. LaBalle
*Assistant Examiner* — Michael A Harrison
(74) *Attorney, Agent, or Firm* — Sughrue Mion, PLLC

(57) ABSTRACT

A rotation device includes: a rotary body having a recess in an outer peripheral surface thereof; and a brush configured to come into contact with the outer peripheral surface of the rotary body to remove a foreign matter adhering to the outer peripheral surface, in which the brush is separated from the outer peripheral surface of the rotary body in a state where rotation of the rotary body is stopped.

16 Claims, 9 Drawing Sheets

ROTATION DEVICE AND IMAGE FORMING APPARATUS

CROSS-REFERENCE TO RELATED APPLICATIONS

This application is based on and claims priority under 35 USC 119 from Japanese Patent Application No. 2020-167886 filed Oct. 2, 2020.

BACKGROUND

(i) Technical Field

The present disclosure relates to a rotation device and an image forming apparatus.

(ii) Related Art

JP-A-58-005769 discloses a transfer device for transferring an image on an image carrier. The transfer device includes a transferred material transporting unit, a gripper piece, and a switch member. The transferred material transporting unit moves a transferred material in an endless manner along a circulating movement path. The gripper piece is attached to the transporting unit. The gripper piece is pivotally supported by a rotating shaft. The gripper piece rotates relative to a base member. The gripper piece holds a leading end side of the transferred material. The switch member is attached to a base member side. In order to detect whether the transferred material is in the gripper, a part of a switch member position in the gripper piece is cut out.

SUMMARY

Consider a rotation device including a rotary body having a recess in an outer peripheral surface thereof, and a brush that comes into contact with the outer peripheral surface of the rotary body to remove foreign matter adhering to the outer peripheral surface. If this rotation device has a configuration that the brush is in contact with the outer peripheral surface of the rotary body in a state in which the rotation of the rotary body is stopped, settling of the brush may occur.

Aspects of non-limiting embodiments of the present disclosure relate to preventing settling of a brush in a state in which rotation of a rotary body is stopped, as compared to a configuration in which the brush is in contact with an outer peripheral surface of the rotary body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a rotation device including: a rotary body having a recess in an outer peripheral surface thereof; and a brush configured to come into contact with the outer peripheral surface of the rotary body to remove a foreign matter adhering to the outer peripheral surface, in which the brush is separated from the outer peripheral surface of the rotary body in a state where rotation of the rotary body is stopped.

BRIEF DESCRIPTION OF THE DRAWINGS

Exemplary embodiment(s) of the present disclosure will be described in detail based on the following figures, wherein.

DETAILED DESCRIPTION

Hereinafter, an example of an exemplary embodiment according to the present disclosure will be described with reference to the accompanying drawings.

First Exemplary Embodiment

Image Forming Apparatus 10

Figure 1:
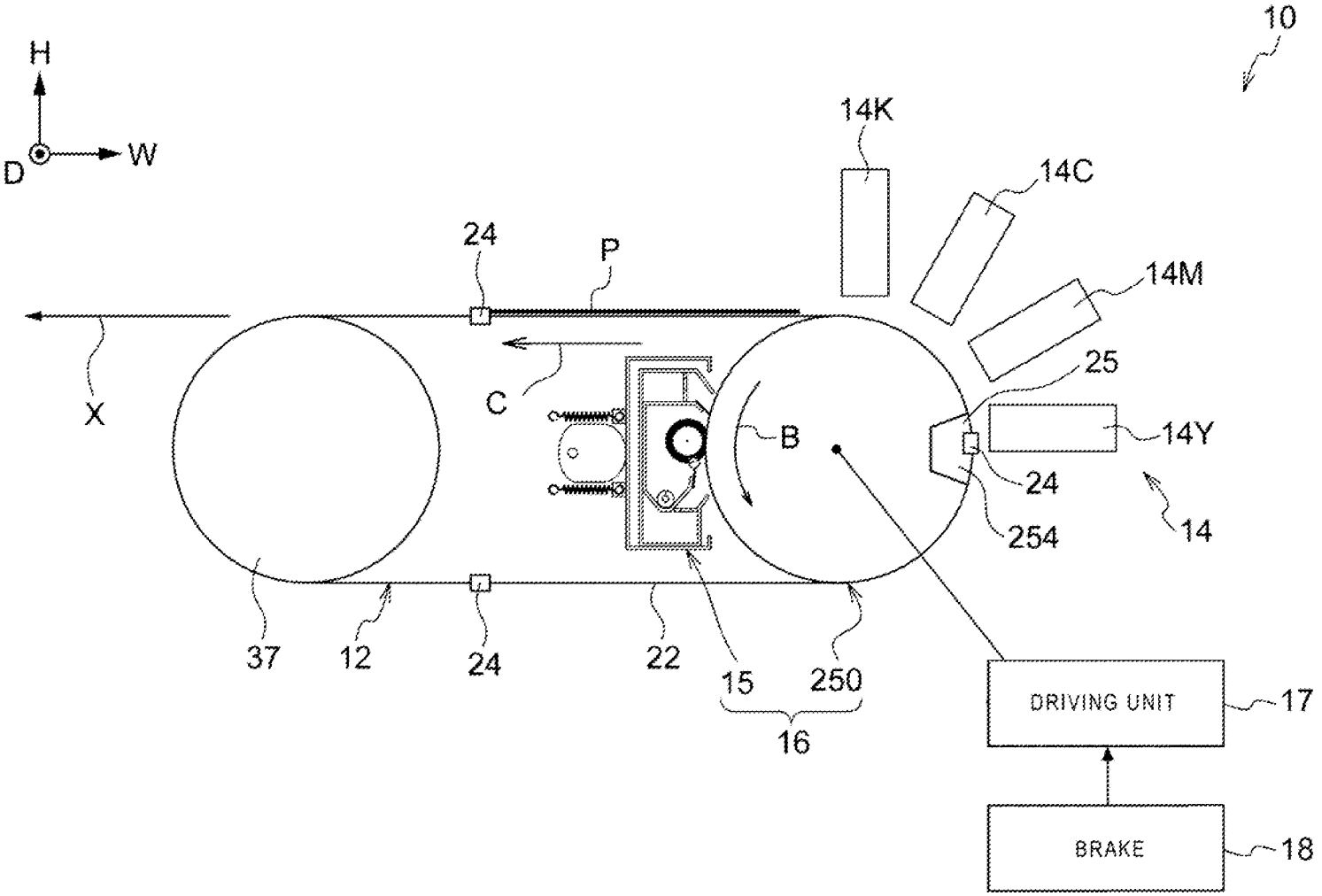
FIG. 1 is a schematic diagram showing a configuration of an image forming apparatus according to a first exemplary embodiment.

A configuration of an image forming apparatus 10 according to the first exemplary embodiment will be described. FIG. 1 is a schematic view showing the configuration of the image forming apparatus 10 according to the present exemplary embodiment. In the drawings, an arrow H indicates an apparatus height direction which is a vertical direction, an arrow W indicates an apparatus width direction which is one of horizontal directions, and an arrow D indicates an apparatus depth direction which is another one of the horizontal directions (a front to rear direction of the apparatus). Dimensional ratios in the H direction, the W direction, and the D direction of respective elements shown in the respective drawings may be different from actual dimensional ratios.

The image forming apparatus 10 shown in FIG. 1 is an inkjet image forming apparatus that forms an ink image (an example of an image) on a recording medium P. Specifically, the image forming apparatus 10 includes an image forming unit 14, a transport mechanism 12, and an opposing cylinder 250. Hereinafter, each of elements (that is, the image forming unit 14, the transport mechanism 12, and the opposing cylinder 250) of the image forming apparatus 10 will be described.

Image Forming Unit 14

The image forming unit 14 has a function of forming an ink image on a transported recording medium P. Specifically, as shown in FIG. 1, the image forming unit 14 includes ejection units 14Y, 14M, 14C, and 14K (hereinafter, referred to as 14Y to 14K) that eject ink to predetermined ejection positions.

The ejection units 14Y to 14K are disposed in the above order toward a downstream side in a transport direction of the recording medium P. The ejection units 14Y to 14K are elongated along a width direction of the recording medium P. The width direction of the recording medium P is a direction that intersects the transport direction (specifically, a direction which is perpendicular to the transport direction), and is a direction extending along the front to rear direction of the apparatus.

In the image forming unit 14, the ejection units 14Y to 14K eject ink droplets onto the recording medium P, which is transported by the transport mechanism 12, using a known technique such as a thermal technique or a piezoelectric technique to form the ink image on the recording medium P.

Transport Mechanism 12

Figure 2:
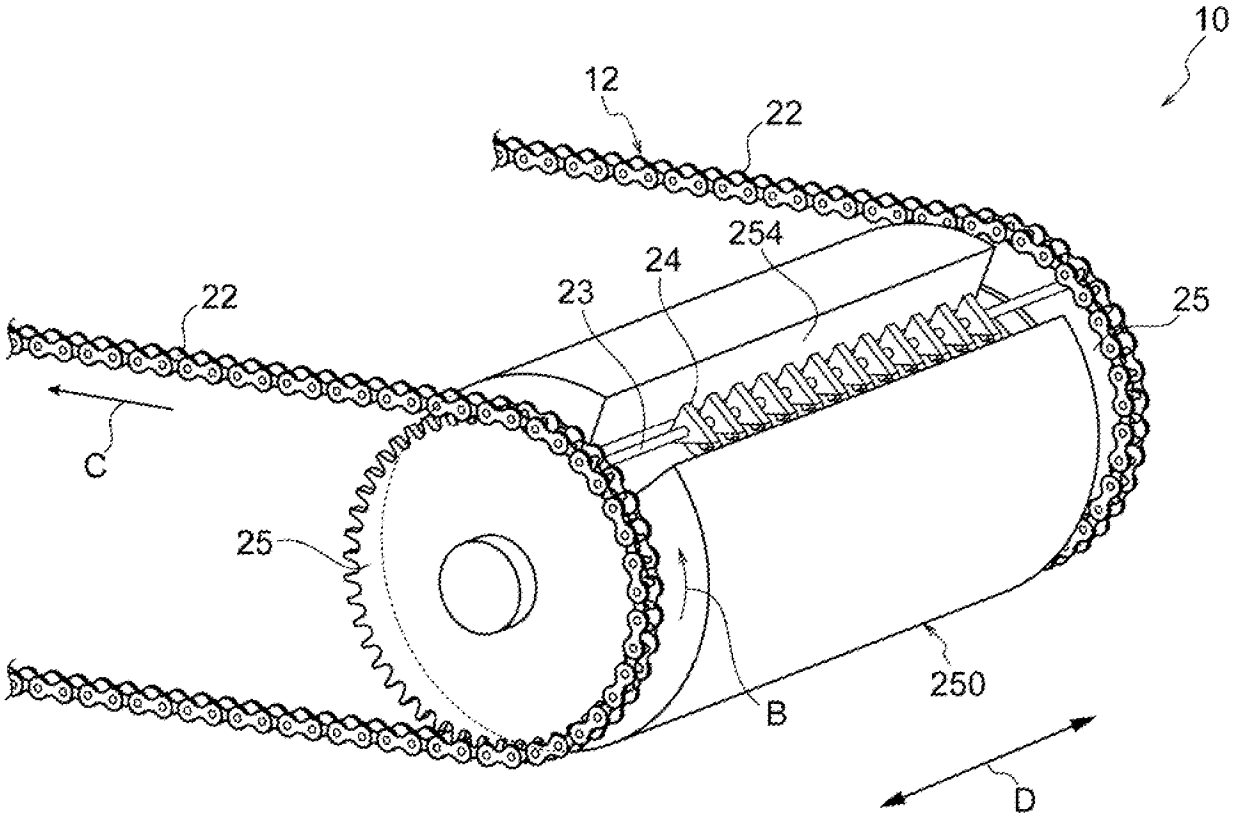
FIG. 2 is a perspective view showing a configuration around a transfer cylinder according to the first exemplary embodiment.

The transport mechanism 12 shown in FIG. 1 is a mechanism that transports the recording medium P. As shown in FIGS. 1 and 2, the transport mechanism 12 includes a pair of chains 22, and the grippers 24. In FIG. 1, one of the chains 22 is shown, and the chain 22 and the grippers 24 are shown in a simplified manner.

As shown in FIG. 1, each of the chains 22 is formed in an annular shape. As shown in FIG. 2, the chains 22 are arranged at an interval in the apparatus depth direction (that is, a D direction in FIG. 2). Each of the chains 22 is wound on a respective one of the sprockets 25 and a respective one of the sprockets 37 (see FIG. 1). The sprockets 25 are provided at both ends, in the axial direction, of the opposing cylinder 250. The opposing cylinder 250 and the pair of sprockets 25 are integrally rotationally driven in a rotation direction B (a direction of the arrow B), and thereby the chain 22 circulates in a circulating direction C (a direction of the arrow C).

As shown in FIG. 2, an attachment member 23 to which grippers 24 are attached bridges between the chains 22 along the apparatus depth direction. The plural attachment members 23 are fixed to the pair of chains 22 at predetermined intervals along the circulating direction C of the chains 22.

Figure 3:
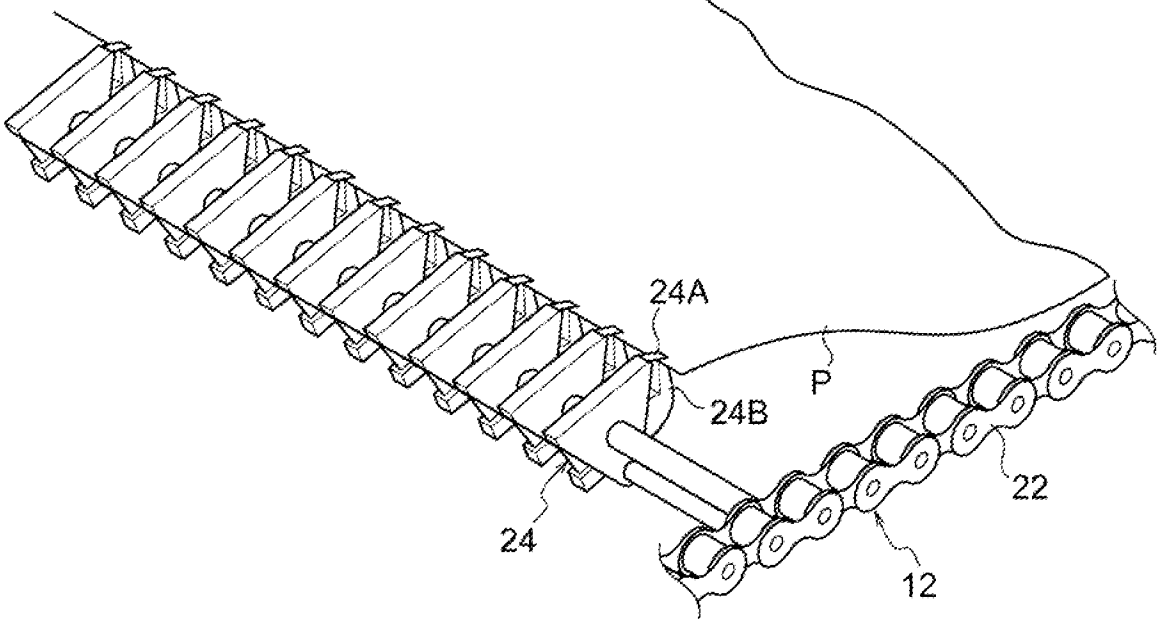
FIG. 3 is a perspective view showing grippers according to the first exemplary embodiment.

As shown in FIG. 2, the plural grippers 24 are attached to the attachment member 23 at predetermined intervals along the apparatus depth direction. The gripper 24 functions as a holder that holds a leading end portion of the recording medium P. Specifically, as shown in FIG. 3, the gripper 24 includes a pawl 24A and a pawl base 24B. The gripper 24 holds the recording medium P by sandwiching the leading end portion of the recording medium P between the pawl 24A and the pawl base 24B. In the gripper 24, for example, the pawl 24A is pressed against the pawl base 24B by a spring, and the pawl 24A is opened from and closed to the pawl base 24B by the action of a cam.

In the transport mechanism 12, as shown in FIG. 3, the grippers 24 hold the leading end portion of the recording medium P sent from an accommodating unit (not illustrated) that accommodates recording media P. The chains 22 circulate in the circulating direction C, so that the grippers 24 holding the leading end portion of the recording medium P transports the recording medium P and causes the recording medium P to pass through the ejection positions of the ejection units 14Y to 14K. Then, the ejection units 14Y to 14K eject the ink droplets onto the recording medium P passing through the ejection positions at timings when the recording medium P is at the ejection positions, thereby forming ink images.

Rotation Device 16

The rotation device 16 includes the opposing cylinder 250, a driving unit 17, a brake 18, and a cleaning device 15. The opposing cylinder 250 is an example of a rotary body. The brake 18 is an example of a separation mechanism and is also an example of a stop unit. The configuration of the brake 18 will be described later.

As shown in FIG. 1, the opposing cylinder 250 is a cylinder member opposing the ejection units 14Y to 14K. The opposing cylinder 250 is formed in a circular shape in a side view and has a recess 254 in an outer peripheral surface thereof. Grippers 24 and an attachment member 23, which will be described later, are accommodated in the recess 254. A specific configuration of the recess 254 will be described later.

As shown in FIG. 2, the pair of sprockets 25 is provided at both end portions, in an axial direction, of the opposing cylinder 250. The sprockets 25 are disposed coaxially with the opposing cylinder 250, and rotate integrally with the opposing cylinder 250. The opposing cylinder 250 and the pair of sprockets 25 are rotationally driven by the driving unit 17 (for example, a motor; see FIG. 1). Hereinafter, the axial direction of the opposing cylinder 250 may be simply referred to as an 'axial direction'.

Figure 4:
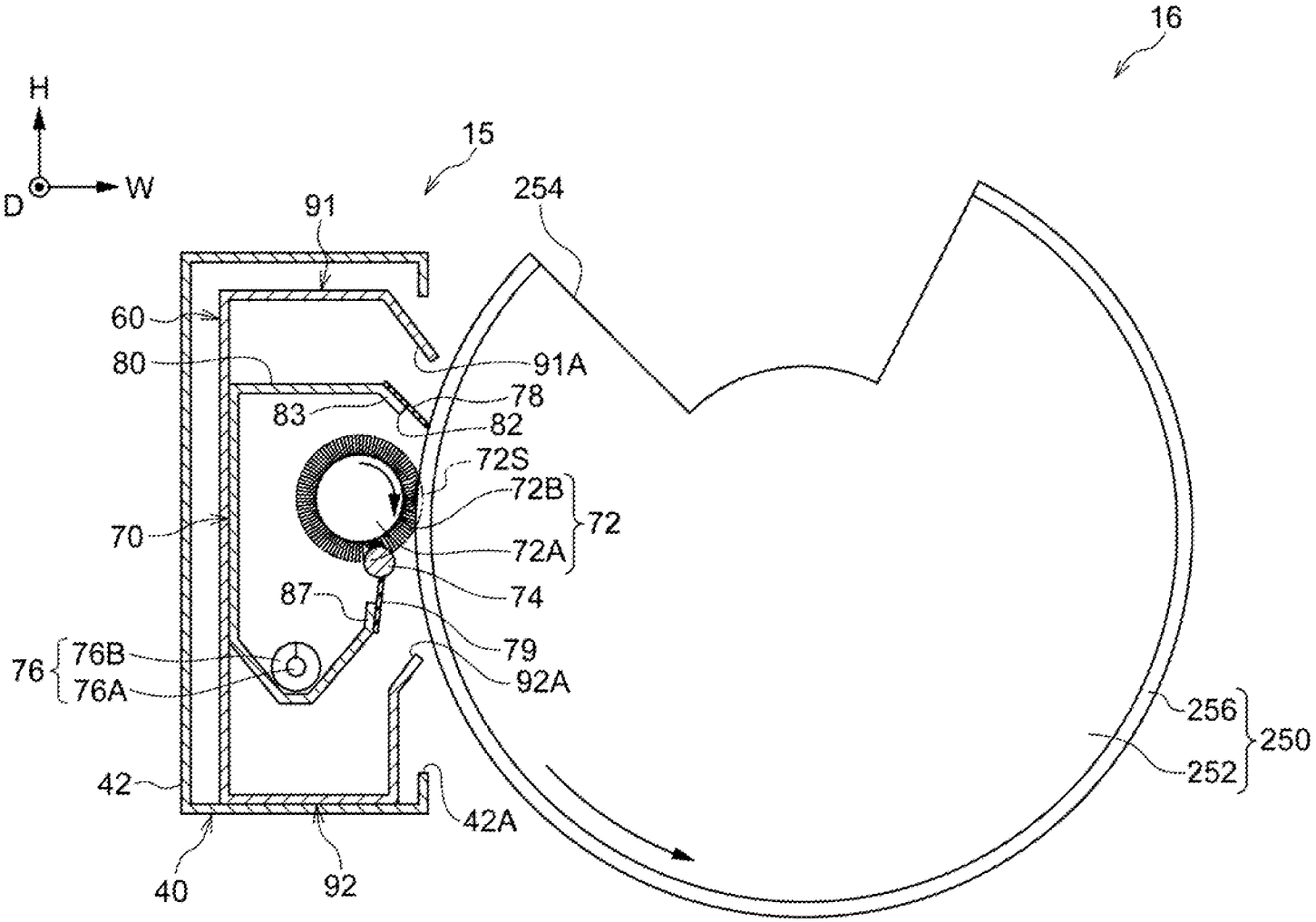
FIG. 4 is a schematic diagram showing a configuration of a cleaning device and the transfer cylinder according to the first exemplary embodiment.

More specifically, as shown in FIG. 4, the opposing cylinder 250 includes a cylinder body 252 and an elastic layer 256. The cylinder body 252 is made of a metal material such as stainless steel or aluminum. The elastic layer 256 is wound around an outer periphery of the cylinder body 252. As the elastic layer 256, for example, a rubber layer made of a foamed rubber is used.

Cleaning Device 15

The cleaning device 15 shown in FIG. 4 is a device that cleans the outer peripheral surface of the opposing cylinder 250. Specifically, the cleaning device 15 is a device that removes foreign matter adhering to the outer peripheral surface of the opposing cylinder 250. As shown in FIG. 4, the cleaning device 15 includes a body 40, a duct frame 60, and a cleaning unit 70. Examples of the foreign matter include ink droplets, and paper dust when the recording medium P is a sheet of paper. In the present exemplary embodiment, the outer peripheral surface of the opposing cylinder 250 is a surface of the elastic layer 256.

Body 40 of Cleaning Device 15

As shown in FIG. 4, the body 40 includes a box-shaped housing 42. The housing 42 is formed in a substantially rectangular parallelepiped shape and is elongated along the axial direction. The housing 42 has an opening 42A that opens toward the opposing cylinder 250 (that is, opens rightward in FIG. 4).

Duct Frame 60 and Cleaning Unit 70

As shown in FIG. 4, the duct frame 60 and the cleaning unit 70 are disposed inside the housing 42 of the body 40.

The cleaning unit 70 includes a box-shaped housing 80, a brush 72, a flicker 74, a transport auger 76, and seal members 78 and 79. The flicker 74 is an example of a contact member.

The housing 80 is formed in a substantially rectangular parallelepiped shape and is elongated along the axial direction. The housing 80 has an opening 82 that opens toward the opposing cylinder 250 (that is, opens rightward in FIG. 4).

The brush 72 includes a shaft portion 72A and a brush portion 72B provided on an outer periphery of the shaft portion 72A. The brush portion 72B is disposed over the entire circumference of the shaft portion 72A. The brush portion 72B includes fibers that extend radially outward from the shaft portion 72A. As the fibers, for example, resin fibers such as polyethylene terephthalate (PET) is used. A fiber diameter of the fiber is, for example, 2d (denier) or more and 15d (denier) or less. A fiber density is, for example, 10,000 fibers/inch$^2$ or more and 120,000 fibers/inch$^2$ or less. A part of the brush portion 72B in the circumferential direction is a contact portion that comes into contact with the outer peripheral surface of the opposing cylinder 250.

Specifically, the brush 72 is housed inside the housing 80. The contact portion of the brush portion 72B to the opposing cylinder 250 is exposed through the opening 82. Then, the contact portion of the brush portion 72B comes into contact with the outer peripheral surface of the opposing cylinder 250.

The shaft portion 72A of the brush 72 extends in the front to rear direction of the apparatus. Both end portions of the shaft portion 72A in the axial direction are rotatably supported by the body 40 of the cleaning device 15. The shaft portion 72A of the brush 72 is driven by a driving unit (not illustrated), so that the brush 72 rotates in a forward direction with respect to a rotation direction of the opposing cylinder 250. That is, while the opposing cylinder 250 rotates in a counterclockwise direction in FIG. 4, the brush 72 rotates in a clockwise direction in FIG. 4. A circumferential speed ratio of the brush 72 to the opposing cylinder 250 is more than 1. That is, the circumferential speed of the brush 72 is faster than the circumferential speed of the opposing cylinder 250. In the present exemplary embodiment, the circumferential speed ratio of the brush 72 to the opposing cylinder 250 is in a range of, for example, 1 and 2.5 (inclusive). The circumferential speed of the brush 72 is a circumferential speed of a tip of a part that does not penetrate into the opposing cylinder 250.

In the brush 72, each part of the brush portion 72B in the circumferential direction repeatedly comes into contact with and separates from the outer peripheral surface of the opposing cylinder 250 as the brush portion 72B rotates. Then, the brush portion 72B elastically deformed by coming into contact with the outer peripheral surface of the opposing cylinder 250 elastically restores, to thereby repel the foreign matter adhering to the outer peripheral surface of the opposing cylinder 250, and physically remove the foreign matter from the outer peripheral surface.

The brush 72 may remove the foreign matter from the outer peripheral surface of the opposing cylinder 250 by electrostatic force in addition to or instead of the physical removal described above.

The flicker 74 is disposed below the brush 72 and is in contact with the brush portion 72B. The flicker 74 is formed in a rod shape and has a circular cross section. The flicker 74 contacts with the rotating brush 72 to drop the foreign matter adhering to the brush 72. The dropped foreign matter is accommodated inside the housing 80 and accumulates on a bottom surface inside the housing 80.

Figure 5:
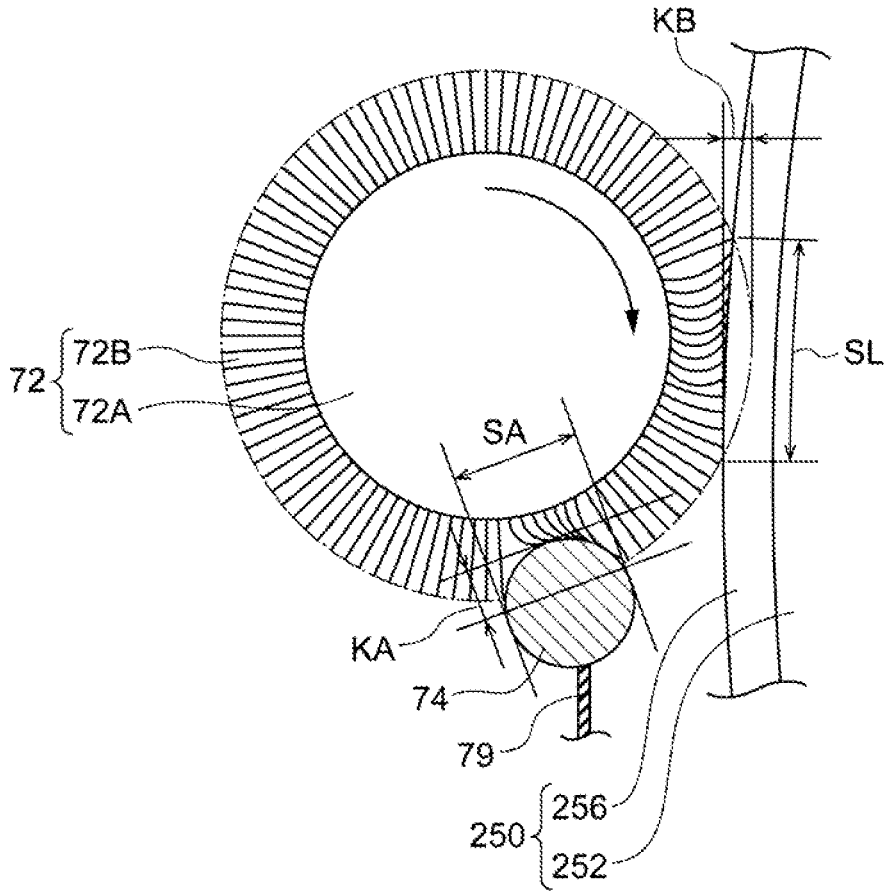
FIG. 5 is a schematic diagram showing a brush and a flicker according to the first exemplary embodiment.

In the present exemplary embodiment, as shown in FIG. 5, KA>KB, where KA is a penetration depth of the brush 72 into the flicker 74, and KB is a penetration depth of the brush 72 into the opposing cylinder 250. The penetration depth KA is a length by which the brush 72 and the flicker 74 overlap each other in a radial direction of the brush 72. The penetration depth KB is a length by which the brush 72 and the opposing cylinder 250 overlap each other in a radial direction of the brush 72. In the present exemplary embodiment, the penetration depth KA is, for example, 0.5 mm or more and 3.0 mm or less, and the penetration depth KB is, for example, 0.3 mm or more and 2.8 mm or less.

In the present exemplary embodiment, SL>SA, where SA is a contact width between the brush 72 and the flicker 74 as viewed in the axial direction, and SL is a contact width between the brush 72 and the outer peripheral surface of the opposing cylinder 250 as viewed in the axial direction. Therefore, the number of contacting filaments of the brush 72 that are in contact with the outer peripheral surface of the opposing cylinder 250 is larger than the number of contacting filaments of the brush 72 that are in contact with the flicker 74. The number of contacting filaments can also be said to be the number of deformed filaments of the brush 72. The contact width SA is, for example, 3 mm or more and 15 mm or less, and the contact width SL is, for example, 5 mm or more and 20 mm or less. The length of the fibers of the brush portion 72B (that is, the length in the radial direction) is, for example, 4 mm or more and 10 mm or less, and the distance between the shaft portion 72A of the brush 72 and the opposing cylinder 250 is 1.2 mm or more and 9.7 mm or less.

As shown in FIG. 4, the transport auger 76 is disposed on the bottom surface inside the housing 80. The transport auger 76 includes a shaft portion 76A and a blade portion 76B having a spiral shape. The blade portion 76B is disposed on the outer periphery of the shaft portion 76A.

The shaft portion 76A of the transport auger 76 extends in the front to rear direction of the image forming apparatus 10. Both end portions of the shaft portion 76A in the axial direction are rotatably supported by the body 40. In the transport auger 76, as the shaft portion 76A rotates, the blade portion 76B rotates to transport the foreign matter dropped onto the bottom surface inside the housing 80 rearward along the axial direction of the brush 72, and discharge the foreign matter from a rear end of the housing 80 through a discharge pipe (not illustrated).

The seal members 78 and 79 have a function of preventing the foreign matter accommodated inside the housing 80 from leaking to an outside of the housing 80 through the opening 82 of the housing 80. Each of the seal members 78 and 79 is formed of, for example, a flexible and deformable film material.

As shown in FIG. 4, the seal member 78 is attached to the upper edge 83 provided on an upper side of the opening portion 82 in the housing 80. Specifically, the seal member 78 extends obliquely downward from the upper edge 83 toward the opposing cylinder 250 (that is, the right side in FIG. 4), and a tip portion of the seal member 78 is in contact with the outer peripheral surface of the opposing cylinder 250.

The seal member 79 is attached to the lower edge 87 provided on a lower side of the opening portion 82 of the housing 80. Specifically, the seal member 79 extends upward from the lower edge 87, and a tip portion of the seal member 79 is in contact with the flicker 74.

The duct frame 60 is a frame that is an element constituting ducts 91 and 92. In the present exemplary embodiment, the ducts 91 and 92 are defined by the duct frame 60 and the housing 80 of the cleaning unit 70. The duct 91 is disposed above the brush 72 and above the housing 80.

Figure 6:
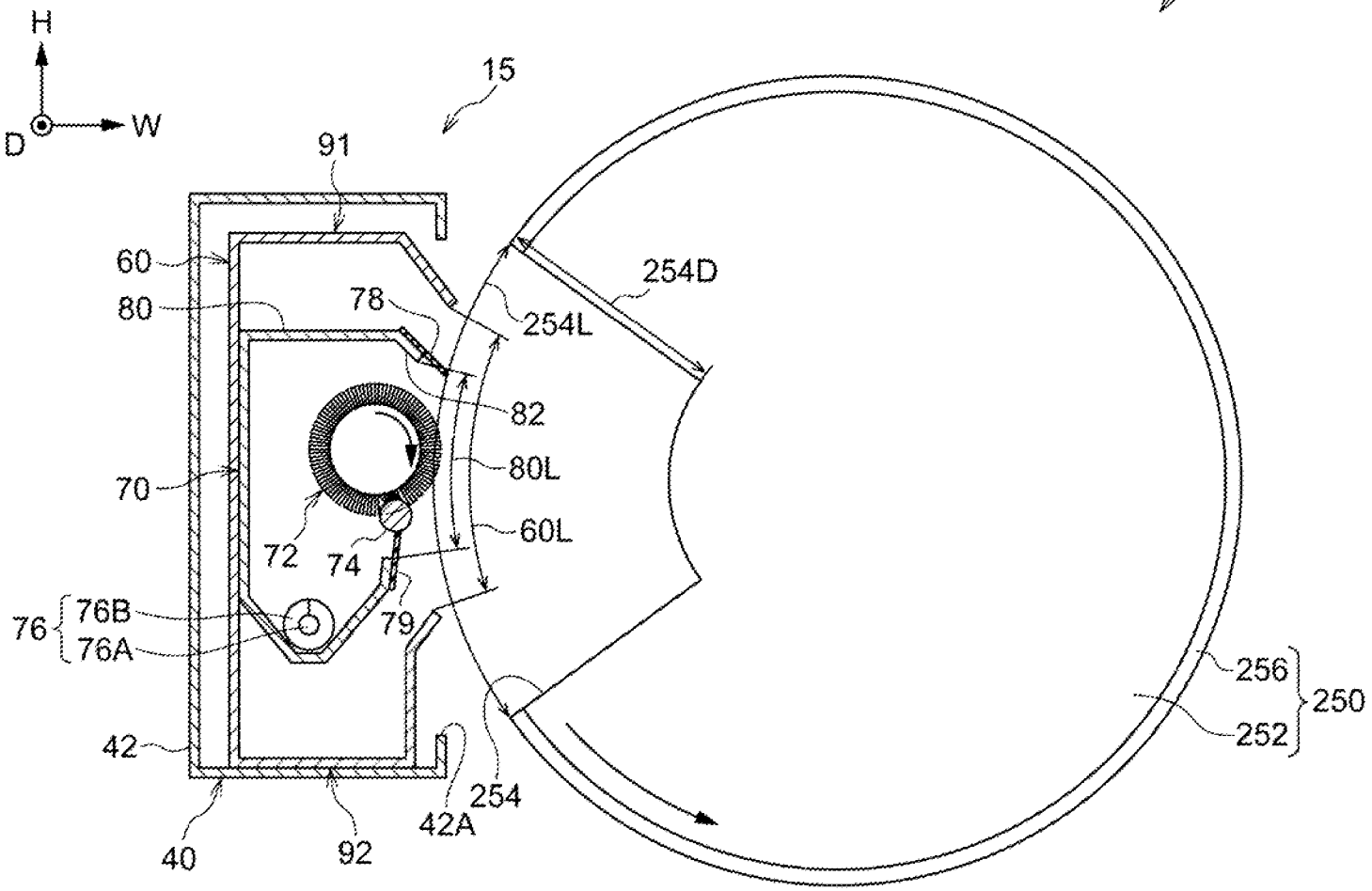
FIG. 6 is a schematic diagram showing a state in which a recess of the transfer cylinder opposes the brush in the cleaning device according to the first exemplary embodiment.

The duct 91 has a suction port 91A that opens toward the opposing cylinder 250. As shown in FIG. 6, when the opposing cylinder 250 is at a rotation position where the recess 254 of the opposing cylinder 250 opposes the brush 72 (that is, a left side in FIG. 6), the suction port 91A opposes the recess 254. That is, the suction port 91A opens at a position above the brush 72. The duct 91 extends in the front to rear direction.

As shown in FIG. 4, the duct 92 is disposed below the brush 72 and below the housing 80. The duct 92 has a suction port 92A that opens toward the opposing cylinder 250. As shown in FIG. 6, when the opposing cylinder 250 is at the rotation position where the recess 254 of the opposing cylinder 250 opposes the brush 72 (that is, the left side in FIG. 6), the suction port 92A opposes the recess 254. That is, the suction port 92A opens at a position below the brush 72. The duct 92 extends in the front to rear direction.

The duct 91 and the duct 92 are connected to each other on the rear side, and a tube (not illustrated) is connected to a coupling portion between the duct 91 and the duct 92. A blower (not illustrated) is provided in the tube. When the blower is driven, air containing the foreign matter is taken into the duct 91 through the suction port 91A and is taken into the duct 92 through the suction port 92A. The air taken into the ducts 91 and 92 flows in the ducts 91 and 92 to the rear side. The air flowing through the ducts 91 and 92 merge with each other, and is discharged through the tube.

Relationship Between Respective Elements of Cleaning Device 15 and Recess 254 of Opposing Cylinder 250

As shown in FIG. 6, one recess 254 of the opposing cylinder 250 is provided in a part of the outer peripheral surface of the opposing cylinder 250 in the circumferential direction. The recess 254 is elongated along the axial direction of the opposing cylinder 250 and has a depth along the radial direction of the opposing cylinder 250.

An opening width 254L (see FIG. 6) of the recess 254 as viewed in the axial direction is wider than a contact width SL (see FIG. 5) between the brush 72 and the outer peripheral surface of the opposing cylinder 250 as viewed in the axial direction. A depth 254D (see FIG. 6) of the recess 254 is larger than the penetration depth KB (see FIG. 5) of the brush 72 into the opposing cylinder 250. Therefore, in a state in which the brush 72 opposes the recess 254, the brush 72 is not in contact with the opposing cylinder 250, and is separated from the outer peripheral surface of the opposing cylinder 250. Further, the opening width 254L of the recess 254 is larger than the outer diameter of the brush 72, larger than an opening width 80L of the opening 82 of the housing 80 as viewed in the axial direction, and larger than a width 60L between a tip of an upper wall of the duct frame 60 and a tip of a lower wall of the duct frame 60 as viewed in the axial direction. The opening width 254L, the contact width SL, the opening width 80L, and the width 60L are widths along the circumferential direction of the opposing cylinder 250.

Brake 18

For example, the brake 18 illustrated in FIG. 1 stops the rotation of the opposing cylinder 250 by holding a rotating shaft of the opposing cylinder 250. Specifically, when the opposing cylinder 250 transitions from a mode in which the opposing cylinder 250 rotates (hereinafter, referred to as a "rotation mode") to a mode in which the rotation of the opposing cylinder 250 stops (hereinafter, referred to as a "stop mode"), the brake 18 stops the rotation of the opposing cylinder 250 at a position (a position shown in FIG. 6) at which the recess 254 opposes the brush 72.

Examples of the rotation mode include a state in which an image formation process of forming an ink image on the recording medium P is executed. Examples of the stop mode include (i) a standby state in which the image formation process is not executed and (ii) a state in which an operation of the image forming apparatus 10 is stopped when a power of the image forming apparatus 10 is turned off.

In the present exemplary embodiment, the brake 18 stops the rotation of the opposing cylinder 250 at the position where the recess 254 opposes the brush 72, to thereby separate the brush 72 from the outer peripheral surface of the opposing cylinder 250 in a state where the rotation of the opposing cylinder 250 is stopped. A detector such as an optical sensor detects if the recess 254 is at the position where the recess 254 opposes the brush 72.

Effect of the Present Exemplary Embodiment

According to the present exemplary embodiment, as described above, when the opposing cylinder 250 transitions from the rotation mode to the stop mode, the brake 18 stops the rotation of the opposing cylinder 250 at the position where the recess 254 opposes the brush 72. As a result, the brake 18 separates the brush 72 from the outer peripheral surface of the opposing cylinder 250 in a state where the rotation of the opposing cylinder 250 is stopped.

In the present exemplary embodiment, the flicker 74 comes into contact with the rotating brush 72 to drop the foreign matter adhering to the brush 72.

In the present exemplary embodiment, as shown in FIG. 5, KA>KB, where KA is the penetration depth of the brush 72 into the flicker 74, and KB is the penetration depth of the brush 72 into the opposing cylinder 250.

In the present exemplary embodiment, SL>SA, where SA is the contact width between the brush 72 and the flicker 74 as viewed in the axial direction, and SL is the contact width between the brush 72 and the outer peripheral surface of the opposing cylinder 250 as viewed in the axial direction. Here, since the brush 72 can be separated from the outer peripheral surface of the opposing cylinder 250, it is possible to prevent the settling of the brush 72 due to the brush 72 contacting with the opposing cylinder 250.

Second Exemplary Embodiment

Image Forming Apparatus 200

Figure 7:
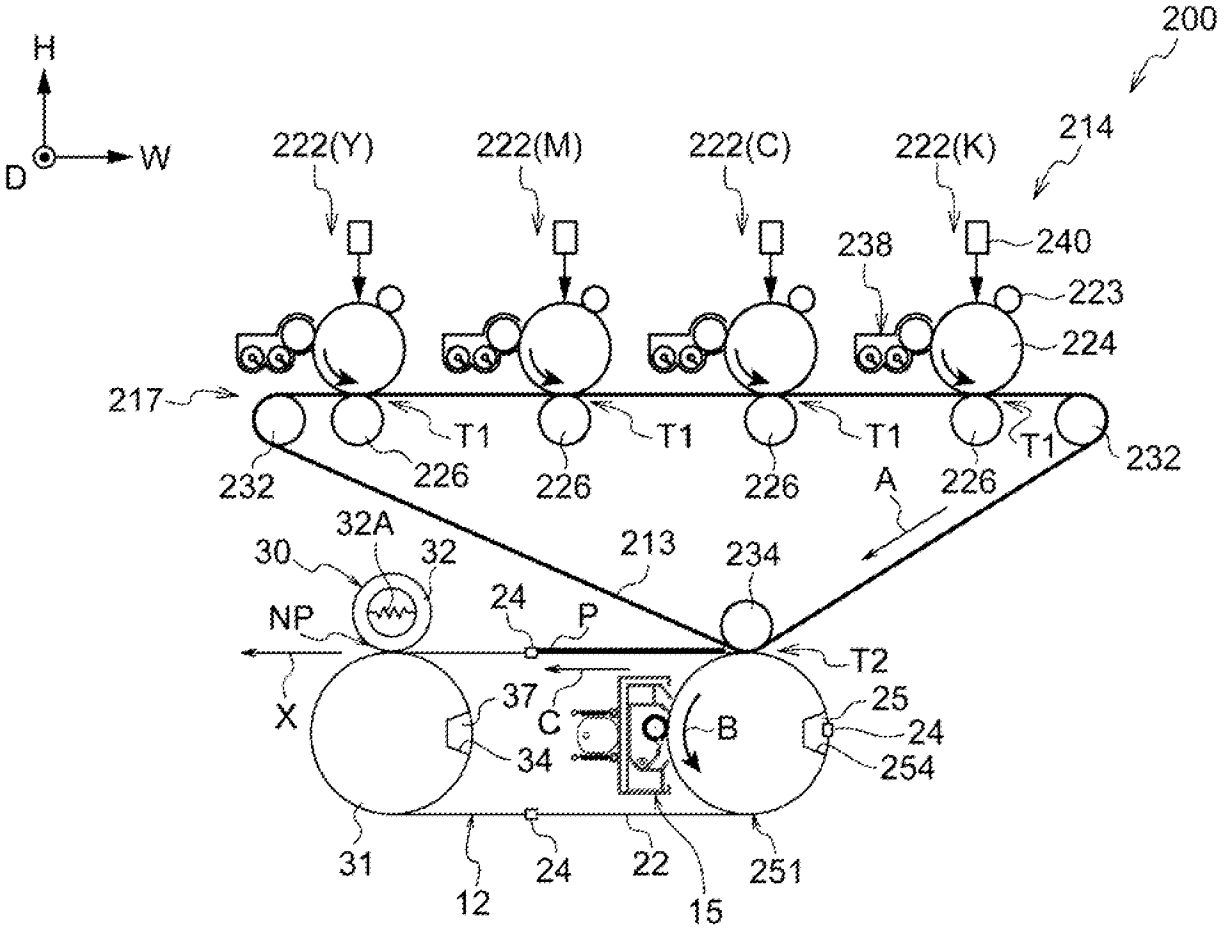
FIG. 7 is a schematic diagram showing a configuration of an image forming apparatus according to a second exemplary embodiment.

In the first exemplary embodiment, the image forming apparatus 10 is the inkjet image forming apparatus that forms an image on the recording medium P using the ink. The present disclosure is not limited thereto. As an example of the image forming apparatus, for example, an electrophotographic image forming apparatus may be used, and any device that forms an image may be used. In the second exemplary embodiment, the electrophotographic image forming apparatus 200 will be described. FIG. 7 is a schematic diagram showing a configuration of an image forming apparatus 200 according to the present exemplary embodiment. Parts having same functions as those in the first exemplary embodiment are denoted by the same reference numerals, and description thereof is omitted as appropriate.

Image Forming Unit 214

The image forming apparatus 200 includes an image forming unit 214 instead of the image forming unit 14. The image forming unit 214 has a function of forming a toner image (an example of an image) on a recording medium P by an electrophotographic technique. Specifically, as shown in FIG. 7, the image forming unit 214 includes toner image forming units 222 that form toner images, and a transfer device 217 that transfers the toner images formed by the toner image forming units 222 to the recording medium P.

Toner Image Forming Unit 222

The toner image forming units 222 shown in FIG. 7 are provided so as to form toner images of respective colors. In the present exemplary embodiment, the toner image forming unit 222 of four colors of yellow (Y), magenta (M), cyan (C), and black (K) are provided. (Y), (M), (C), and (K) shown in FIG. 7 represent components corresponding to the respective colors described above.

Since the toner image forming units 222 of the respective colors have similar configuration except for a toner used therein, the reference numerals are given to the respective elements of the toner image forming unit 222(K) in FIG. 7 as a representative of the toner image forming units 222 of the respective colors.

Specifically, the toner image forming unit 222 of each color includes a photoconductor 224 that rotates in one direction (for example, a counterclockwise direction in FIG. 7). The toner image forming unit 222 of each color includes a charging unit 223, an exposure device 240, and a developing device 238.

In the toner image forming unit 222 of each color, the charging unit 223 charges the photoconductor 224. Further, the exposure device 240 exposes the photoconductor 224 charged by the charging unit 223 to form an electrostatic latent image on the photoconductor 224. The developing device 238 develops the electrostatic latent image formed on the photoconductor 224 by the exposure device 240, to form a toner image.

Transfer Device 217

The transfer device 217 shown in FIG. 7 is a device that transfers the toner image formed by the toner image forming unit 222 to the recording medium P. Specifically, the transfer device 217 primarily transfers the toner images of the photoconductors 224 of the respective colors onto a transfer belt 213 (as an intermediate transfer body) in a superimposed manner, and secondarily transfers the superimposed toner images onto the recording medium P. As shown in FIG. 7, the transfer device 217 includes the transfer belt 213, primary transfer rollers 226, and a transfer cylinder 251 instead of the opposing cylinder 250. The transfer cylinder 251 is an example of the rotary body, and the transfer belt 213 is an example of a transfer unit.

Each primary transfer roller 226 is a roller that transfers the toner image of the photoconductor 224 of the corresponding color to the transfer belt 213 at a primary transfer position T1 between the photoconductor 224 and the primary transfer roller 226. In the present exemplary embodiment, a primary transfer electric field is applied between the primary transfer roller 226 and the photoconductor 224, so that the toner image formed on the photoconductor 224 is transferred to the transfer belt 213 at the primary transfer position T1.

The toner images are transferred from the photoconductors 224 of the respective colors to the outer peripheral surface of the transfer belt 213. As shown in FIG. 7, the transfer belt 213 has an endless shape. The transfer belt 213 is wound on plural rollers 232 and an opposing roller 234 so as to have an inverted triangle shape in a front view (as viewed in the apparatus depth direction). The transfer belt 213 circulates in a direction of an arrow A as at least one of the plural rollers 232 is rotationally driven.

The transfer cylinder 251 is a transfer body that transfers the toner image transferred to the transfer belt 213 to the recording medium P at a secondary transfer position T2 between the opposing roller 234 and the transfer cylinder 251. In the present exemplary embodiment, when a secondary transfer electric field is applied between the opposing roller 234 and the transfer cylinder 251, the toner image transferred to the transfer belt 213 is transferred to the recording medium P at the secondary transfer position T2. The transfer belt 213 and the outer peripheral surface of the transfer cylinder 251 are in contact with each other at the secondary transfer position T2. The toner image is transferred while the transfer belt 213 and the transfer cylinder 251 transport the recording medium P in a state of nipping the recording medium P at the secondary transfer position T2. The transfer cylinder 251 is configured in a similar manner as the opposing cylinder 250 in the first exemplary embodiment.

Fixing Device 30

In the present exemplary embodiment, the fixing device 30 functions as a device that fixes the toner image transferred to the recording medium P by the transfer cylinder 251 to the recording medium P. Specifically, as shown in FIG. 1, the fixing device 30 includes a pressure roller 31 and a heating roller 32.

In the fixing device 30, the heating roller 32 is disposed above the pressure roller 31. The heating roller 32 has a heating source 32A such as a halogen lamp inside the heating roller 32.

The pressure roller 31 has a recess 34 in an outer peripheral surface thereof. One recess 34 is provided in a part of the outer peripheral surface of the pressure roller 31 in a circumferential direction. Further, the recess 34 is elongated along the axial direction of the pressure roller 31 and has a depth along a radial direction of the pressure roller 31. The grippers 24 and the attachment member 23, which will be described later, are accommodated in the recess 34.

The pair of sprockets 37 according to the first exemplary embodiment is provided at both axial end portions of the pressure roller 31. The pair of sprockets 37 is disposed coaxially with the pressure roller 31, and rotate integrally with the pressure roller 31.

The fixing device 30 fixes the toner image transferred to the recording medium P to the recording medium P by heating and pressing the recording medium P while transporting the recording medium P in a state in which the recording medium P is sandwiched at the fixing position NP between the heating roller 32 and the pressure roller 31.

In the image forming apparatus 200, as the chain 22 circulates in the circulating direction C in a state in which the grippers 24 hold a leading end portion of the recording medium P, a transport mechanism 12 causes the recording medium P to pass through the secondary transfer position T2 and a fixing position NP between the pressure roller 31 and the heating roller 32. Then, the toner images primarily transferred onto the transfer belt 213 in the superimposed manner at the primary transfer positions T1 of the respective colors are secondarily transferred onto the recording medium P at the secondary transfer position T2. The toner image secondarily transferred to the recording medium P is fixed to the recording medium P at the fixing position NP.

The cleaning device 15 according to the present exemplary embodiment is configured in a similar manner as the cleaning device 15 in the first exemplary embodiment, and the present exemplary embodiment has a similar effect as that of the first exemplary embodiment.

Modification of Separation Mechanism

In the first exemplary embodiment, the brake 18 stops the rotation of the opposing cylinder 250 at the position where the recess 254 opposes the brush 72, to thereby separate the brush 72 from the outer peripheral surface of the opposing cylinder 250. The present disclosure is not limited thereto. A moving mechanism 50 shown in FIG. 8 may be used as the separation mechanism. The modification is also applicable to the second exemplary embodiment. In this case, it is assumed that the opposing cylinder 250 described below is replaced with the transfer cylinder 251.

Figure 8:
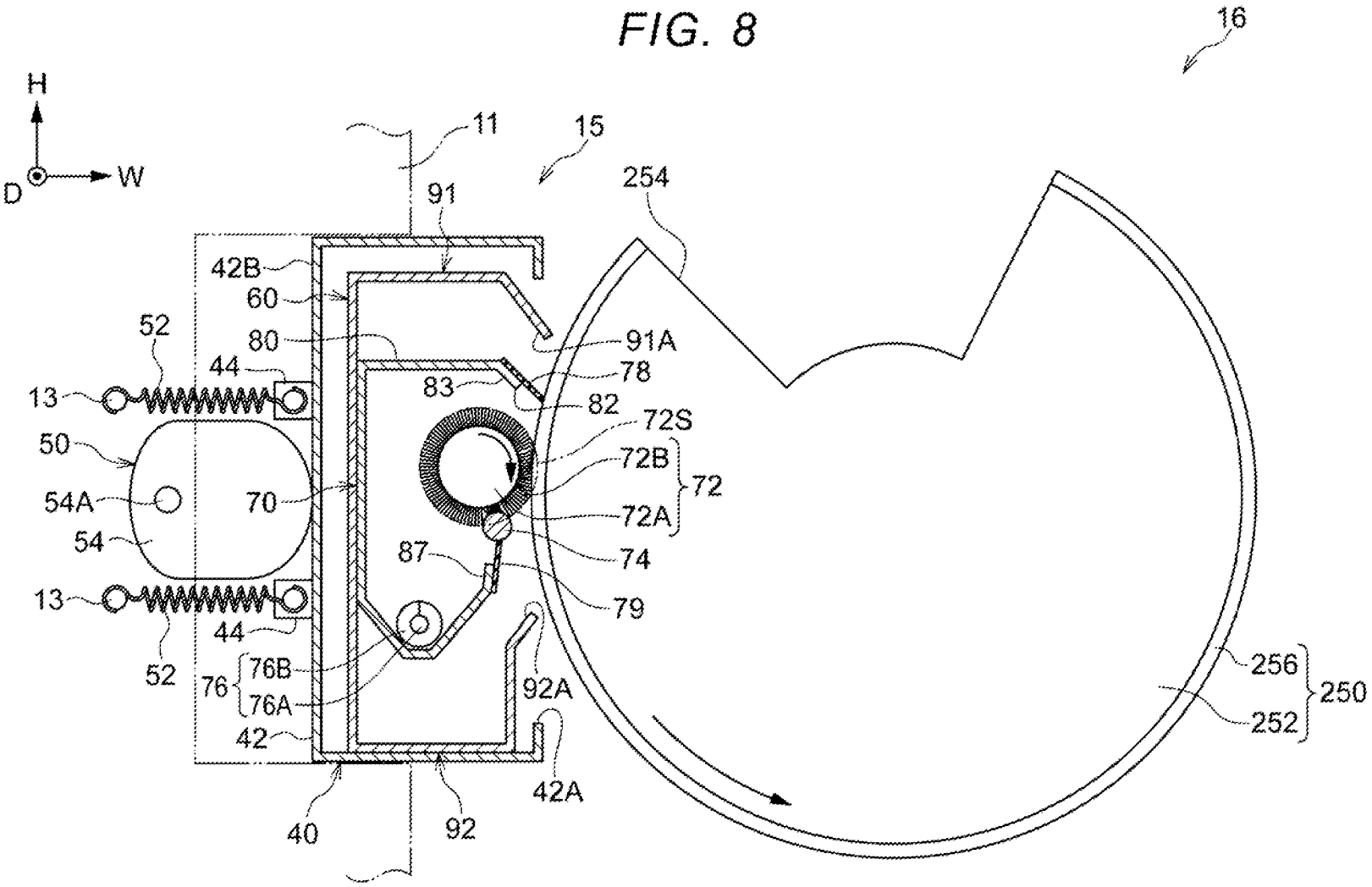
FIG. 8 is a schematic diagram showing a configuration of a cleaning device according to a modification.

In the present modification, as shown in FIG. 8, the body 40 includes attachment portions 44 in addition to the housing 42. In the present modification, the body 40 of the cleaning device 15 is provided in a body 11 of the image forming apparatus 10 such that the body 40 is movable along the apparatus width direction together with the duct frame 60 and the cleaning unit 70. Specifically, the body 40 is movable along the apparatus width direction between an approach position shown in FIG. 8 and a separated position shown in FIG. 9.

Figure 9:
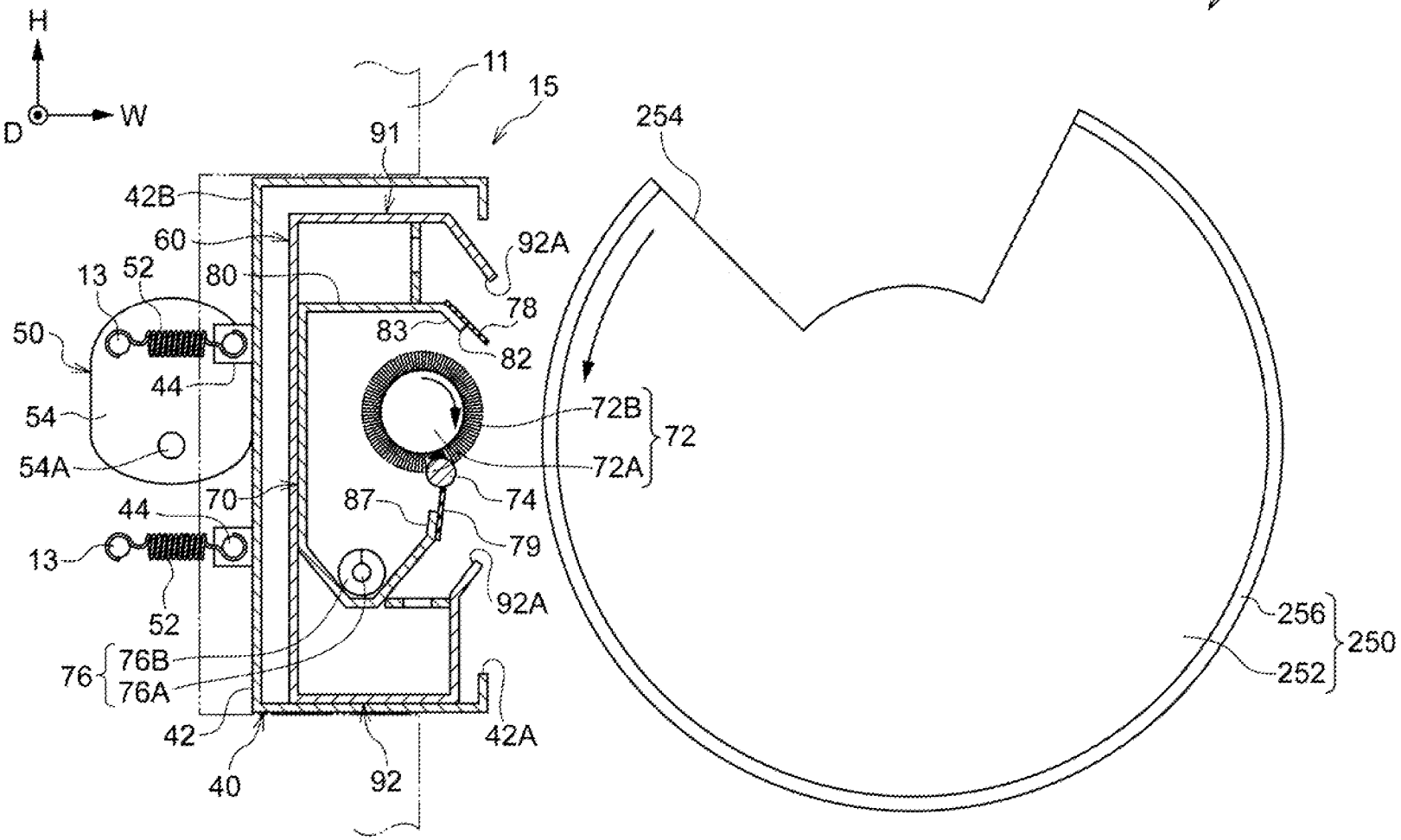
FIG. 9 is a schematic diagram showing a state where a body of the cleaning device according to the modification is located at a separated position.

The approach position shown in FIG. 8 is an approach position with respect to the outer peripheral surface of the opposing cylinder 250. When the body 40 is located at the approach position and the outer peripheral surface of the opposing cylinder 250 opposes the brush 72, the brush 72 comes into contact with the outer peripheral surface of the opposing cylinder 250. When the outer peripheral surface of the opposing cylinder 250 opposes the seal member 78, the seal member 78 is in contact with the outer peripheral surface of the opposing cylinder 250. The separated position shown in FIG. 9 is a separated position with respect to the outer peripheral surface of the opposing cylinder 250. When the body 40 is located at the separated position, the brush 72 is separated from the outer peripheral surface of the opposing cylinder 250.

As shown in FIG. 8, each attachment portion 44 is a part to which a tension spring 52, which will be described later, of the moving mechanism 50 is attached. Two attachment portions 44 are provided on a side wall 42B of the housing 42 on a side opposite to the opposing cylinder 250 (on a left side in FIG. 8).

The moving mechanism 50 is a mechanism that moves the body 40 between the approach position shown in FIG. 8 and the separated position shown in FIG. 9. Specifically, as shown in FIG. 8, the moving mechanism 50 includes the two tension springs 52 and a cam 54. One end portion of each of the two tension springs 52 is attached to a respective one of the attachment portions 44. The other end portion of each of the two tension springs 52 is attached to a respective one of attachment portions 13 provided in the body 11 of the image forming apparatus 10. As a result, the two tension springs 52 pull the cleaning device body 40 toward the separated position (leftward in FIG. 8) relative to the approach position. The cam 54 is provided in the body 11 so as to be swingable about a swing shaft 54A.

When the opposing cylinder 250 transitions from the stop mode to the rotation mode, the cam 54 of the moving mechanism 50 swings and a longer diameter portion of the cam 54 comes into contact with the side wall 42B of the housing 42, so that the body 40 is moved to the approaching position shown in FIG. 8 against an elastic force of the tension springs 52.

When the opposing cylinder 250 transitions from the rotation mode to the stop mode, the cam 54 of the moving mechanism 50 swings and a shorter diameter portion of the cam 54 opposes the side wall 42B of the housing 42, so that the body 40 is moved to the separated position shown in FIG. 9 by the elastic force of the tension springs 52. As a result, the moving mechanism 50 separates the brush 72 from the outer peripheral surface of the opposing cylinder 250 in a state where the rotation of the opposing cylinder 250 is stopped.

In the present modification, since the entire body 40 including the brush 72 and the flicker 74 moves, a positional relationship between the brush 72 and the flicker 74 does not change before and after the body 40 moves to the separated position illustrated in FIG. 9. That is, the moving mechanism 50 separates the brush 72 from the outer peripheral surface of the opposing cylinder 250 without changing the positional relationship between the brush 72 and the flicker 74.

In the present modification, the brush 72 can be separated from the outer peripheral surface of the opposing cylinder 250 regardless of the position of the recess 254, unlike the case where the brake 18 stops the rotation of the opposing cylinder 250 at the position where the recess 254 faces the brush 72 to thereby separate the brush 72 from the outer peripheral surface of the opposing cylinder 250.

Further, in the present modification, the moving mechanism 50 separates the brush 72 from the outer peripheral surface of the opposing cylinder 250 when the removal of the foreign matter is not executed in a state in which the opposing body 250 rotates, that is, in the rotation mode.

The case where the removal of the foreign matter is not executed in the rotation mode refers to a case where the foreign matter is less likely to adhere to the opposing cylinder 250 during execution of the image forming process. Specifically, this corresponds to a case where an image area of an image to be formed on the recording medium P is narrower than a predetermined area.

Further, in the second exemplary embodiment, the case where the removal of the foreign matter is not executed in the rotation mode may be a case where a size of the recording medium P is equal to or larger than a predetermined size.

The rotation device 16 may include both the brake 18 and the moving mechanism 50. In this configuration, the brake 18 and the moving mechanism 50 are selectively used. For example, when the opposing cylinder 250 transitions from the rotation mode to the stop mode, the brush 72 may be separated from the outer peripheral surface of the opposing cylinder 250 using the brake 18, and when removal of foreign matter is not executed in the rotation mode, the brush 72 may be separated from the outer peripheral surface of the opposing cylinder 250 using the moving mechanism 50.

Other Modifications

In the first and second exemplary embodiment, the brush 72 rotates in a forward direction relative to the rotational direction of the opposing cylinder 250. The present disclosure is not limited thereto. For example, the brush 72 may rotate in the opposite direction relative to the rotational direction of the opposing cylinder 250. Also, the brush 72 may not rotate. In this case, for example, the flicker 74 is unnecessary.

In the first and second exemplary embodiments, the circumferential speed ratio of the brush 72 to the opposing cylinder 250 is more than 1. The present disclosure is not limited thereto. The circumferential speed ratio of the brush 72 to the opposing cylinder 250 may be 1 or less.

In the first and second exemplary embodiments, the flicker 74 is provided. Alternatively, the flicker 74 may not be provided.

In the first and second exemplary embodiments, as shown in FIG. 5, KA>KB, where KA is the penetration depth of the brush 72 into the flicker 74, and KB is the penetration depth of the brush 72 into the opposing cylinder 250. The present disclosure is not limited thereto. For example, a relationship of KA≤KB may be met.

In the first and second exemplary embodiments, the cleaning device 15 includes the ducts 91 and 92. The present disclosure is not limited thereto. For example, the cleaning device 15 may include only one of the duct 91 and the duct 92.

In the secondary exemplary embodiment, the transfer belt 213 as the intermediate transfer body is used as an example of the transfer unit. The present disclosure is not limited thereto. As an example of the transfer portion, a photoconductor may be used. Alternatively, a direct transfer type transfer portion may be used.

The present disclosure is not limited to the above exemplary embodiment. Various modifications, changes, and improvements may be made without departing from the scope of the present disclosure. For example, the modifications described above may be combined with each other as appropriate.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A rotation device comprising:

a rotary body having a recess in an outer peripheral surface thereof; and a brush configured to come into contact with the outer peripheral surface of the rotary body to remove a foreign matter adhering to the outer peripheral surface, wherein the brush is separated from the outer peripheral surface of the rotary body in a state where rotation of the rotary body is stopped, and wherein the rotation of the rotary body is stopped at a position where the recess opposes the brush, so as to separate the brush from the outer peripheral surface of the rotary body in a state where the rotation of the rotary body is stopped.

2. The rotation device according to claim 1, further comprising:

a separation mechanism configured to move the brush outward in a radial direction of the rotary body in a state where the rotary body is stopped, so as to separate the brush from the outer peripheral surface of the rotary body.

3. The rotation device according to claim 1, further comprising:

a contact member, wherein the brush rotates, and the contact member is configured to come into contact with the rotating brush to drop the foreign matter adhering to the brush.

4. The rotation device according to claim 2, further comprising:

a contact member, wherein the brush rotates, and the contact member is configured to come into contact with the rotating brush to drop the foreign matter adhering to the brush.

5. The rotation device according to claim 3, further comprising:

a separation mechanism configured to move the brush outward in a radial direction of the rotary body in a state where the rotary body is stopped, so as to separate the brush from the outer peripheral surface of the rotary body without changing a positional relationship between the brush and the contact member.

6. The rotation device according to claim 3, wherein

SL>SA, where

SA is a contact width between the brush and the contact member, and

SL is a contact width between the brush and the rotary body.

7. The rotation device according to claim 4, wherein

SL>SA, where

SA is a contact width between the brush and the contact member, and

SL is a contact width between the brush and the rotary body.

8. The rotation device according to claim 5, wherein

SL>SA, where

SA is a contact width between the brush and the contact member, and

SL is a contact width between the brush and the rotary body.

9. An image forming apparatus comprising:

the rotation device according to claim 1; and a transfer unit configured to come into contact with the outer peripheral surface of the rotary body and transfer a toner to a recording medium passing between the rotary body and the transfer unit, wherein the brush is configured to remove the toner as the foreign matter.

10. An image forming apparatus comprising:

the rotation device according to claim 2; and a transfer unit configured to come into contact with the outer peripheral surface of the rotary body and transfer a toner to a recording medium passing between the rotary body and the transfer unit, wherein the brush is configured to remove the toner as the foreign matter.

11. An image forming apparatus comprising:

the rotation device according to claim 3; and a transfer unit configured to come into contact with the outer peripheral surface of the rotary body and transfer a toner to a recording medium passing between the rotary body and the transfer unit, wherein the brush is configured to remove the toner as the foreign matter.

12. An image forming apparatus comprising:

the rotation device according to claim 1; and a transfer unit configured to come into contact with the outer peripheral surface of the rotary body and transfer a toner to a recording medium passing between the rotary body and the transfer unit, wherein the brush is configured to remove the toner as the foreign matter, wherein, when a size of the recording medium is equal to or larger than a predetermined size, the rotation device separates the brush from the outer peripheral surface of the rotary body in a state in which the rotary body rotates.

13. A rotation device comprising:

a rotary body having a recess in an outer peripheral surface thereof;

a brush configured to come into contact with the outer peripheral surface of the rotary body to remove a foreign matter adhering to the outer peripheral surface; and a contact member, wherein the brush is separated from the outer peripheral surface of the rotary body in a state where rotation of the rotary body is stopped, wherein the brush rotates, wherein the contact member is configured to come into contact with the rotating brush to drop the foreign matter adhering to the brush, and wherein the rotation device further comprises a separation mechanism configured to move the brush outward in a radial direction of the rotary body in a state where the rotary body is stopped, so as to separate the brush from the outer peripheral surface of the rotary body without changing a positional relationship between the brush and the contact member.

14. The rotation device according to claim 13, wherein

SL>SA, where

SA is a contact width between the brush and the contact member, and

SL is a contact width between the brush and the rotary body.

15. A rotation device comprising:

a rotary body having a recess in an outer peripheral surface thereof; and a brush configured to come into contact with the outer peripheral surface of the rotary body to remove a foreign matter adhering to the outer peripheral surface;

a separation mechanism configured to move the brush outward in a radial direction of the rotary body in a state where the rotary body is stopped, so as to separate the brush from the outer peripheral surface of the rotary body; and a contact member, wherein the brush is separated from the outer peripheral surface of the rotary body in a state where rotation of the rotary body is stopped, wherein the brush rotates, wherein the contact member is configured to come into contact with the rotating brush to drop the foreign matter adhering to the brush, and wherein the separation mechanism is configured to separate the brush from the outer peripheral surface of the rotary body without changing a positional relationship between the brush and the contact member.

16. The rotation device according to claim 15, wherein

SL>SA, where

SA is a contact width between the brush and the contact member, and

SL is a contact width between the brush and the rotary body.

* * * * *